United States Patent [19]

Lessard et al.

[11] Patent Number: 5,001,903

[45] Date of Patent: Mar. 26, 1991

[54] OPTIMALLY STAGED CRYOPUMP

[75] Inventors: Philip A. Lessard, Boxboro; Thomas Dunn, Avon, both of Mass.

[73] Assignee: Helix Technology Corporation, Waltham, Mass.

[21] Appl. No.: 470,069

[22] Filed: Jan. 25, 1990

Related U.S. Application Data

[63] Continuation-in-part of Ser. No. 355,048, May 15, 1989, Pat. No. 4,896,511, which is a continuation-in-part of PCT US88/00225 filed Jan. 27, 1988 which is a continuation of Ser. No. 206,952, Jun. 8, 1988 abandoned, which is a continuation of Ser. No. 7,370, Jan. 27, 1987, abandoned.

[51] Int. Cl.[5] ..... B01D 8/00

[52] U.S. Cl. ..... 62/55.5; 55/269; 417/901

[58] Field of Search ..... 62/55.5; 417/901; 55/269

[56] References Cited

U.S. PATENT DOCUMENTS

| | | | |
|---|---|---|---|
| 3,218,815 | 11/1965 | Chellis et al. | 62/6 |
| 4,240,262 | 12/1980 | Nakamura et al. | 62/55.5 |
| 4,438,632 | 3/1984 | Lessard et al. | 62/55.5 |
| 4,608,866 | 9/1986 | Bergquist | 73/40.7 |
| 4,757,689 | 7/1988 | Bachler et al. | 62/55.5 |

FOREIGN PATENT DOCUMENTS

| | | |
|---|---|---|
| 0053784 | 12/1981 | European Pat. Off. . |
| 0158295 | 10/1985 | European Pat. Off. . |
| 58-131381 | 1/1982 | Japan . |
| 60-204981 | 3/1984 | Japan . |
| 60-187781 | 9/1985 | Japan . |

*Primary Examiner*—Ronald C. Capossela

*Attorney, Agent, or Firm*—Hamilton, Brook, Smith & Reynolds

[57] ABSTRACT

A cryopump having at least two temperature stages for pumping gases at their optimal temperatures. A first embodiment has a third temperature stage that is surrounded by and separated from the second temperature stage which is surrounded by and separated from the first temperature stage. Adsorbent placed on the second and third stages are operated at different temperatures to prevent gases with higher critical mobility temperatures from becoming immobilized at the entrance of pores and wells along the surface of the adsorbent. Another embodiment has at least a second stage, a temperature sensor, and a heater to maintain the second stage temperature at optimal level for the gas being pumped.

16 Claims, 4 Drawing Sheets

OPTIMALLY STAGED CRYOPUMP

This is a continuation-in-part of U.S. Ser. No. 07/355,048 filed May 15, 1989, now U.S. Pat. No. 4896581 which is a continuation-in-part of International application No. PCT/U.S.88/011000,225 filed on Jan. 27, 1988 and is also a file wrapper continuation of Ser. No. 07/206,952 filed on June 8, 1988, now abandoned, which was a file wrapper continuation of Ser. No. 07/007,370 filed on Jan. 27, 1987, now abandoned.

BACKGROUND OF THE INVENTION

Cryopumps are typically used in equipment for the manufacture of integrated circuits and other electronic components, as well as for the deposition of thin films in a variety of consumer and industrial products. The cryopumps are used to create a vacuum by freezing or pumping out gases in a work environment. Refrigerators employed by the cryopumps for pumping out gases may be open or closed-cycle cryogenic refrigerators. The most common refrigerator used is a two-stage cold finger, closed-cycle refrigerator.

Typically, the cold end of the second stage, which is the coldest stage of the two-stage refrigerator, is connected to a primary pumping surface. The primary pumping surface operates in a temperature range of 4° to 25° K. The first stage of the two-stage refrigerator is connected to a radiation shield which surrounds the primary pumping surface. The spacing between the primary pumping surface and the radiation shield must be sufficient to permit unobstructed flow of low-boiling temperature gases from a vacuum chamber created by the shield to the primary pumping surface. The radiation shield typically operates in a range of 70° to 140° K. Separating the evacuation chamber and the radiation shield is a frontal array, which also serves as a radiation shield for the primary pumping surface. The frontal array is typically cooled to 110° K.-130° K. By thermally coupling it to the radiation schield.

In operation, high boiling point gases, such as water vapor, are condensed on the frontal array. Lower boiling point gases pass through that array and into a volume within the radiation shielding, where they condense on the primary pumping surface. An adsorbent, such as charcoal, is typically placed adjacent to the primary pumping surface and is operated at a temperature of that surface to adsorb gases which have very low boiling point temperatures and are not condensed on the primary surface.

Multiple stage refrigerators have used temperature measuring and control devices on the first and second stages to prevent crossover hangup during cooling and for full or partial regeneration procedures. Such a temperature control system is described in U.S. Pat. No. 4,679,401, where a refrigerant gas is diverted and brought into heat exchange relationship with the first and/or second stage heat sinks of a cryopump. By controlling the flow and temperature of the diverted refrigerant gas the problems of crossover hangup and or achieving more efficient regeneration can be addressed.

DISCLOSURE OF THE INVENTION

The present invention relates to a cryopump having different temperature stages for effectively pumping gases.

The present invention differs from conventional cryopumps which provide a temperature stage having an adsorbent that is cooled as cold as possible for pumping gases which were not pumped on the first temperature stage, which is typically used for pumping water. In the conventional cryopumps, the adsorbent surface is not effectively utilized for pumping gases because as the adsorbent is cooled to a temperature for adsorbing gases having a lower critical mobility temperature, gases with higher critical mobility temperatures become immobile at the entrance of the pores and wells As a result, a smaller amount of surface area becomes available for adsorbing gases. Thus, the advantage of the present invention over conventional cryopumps is that internal surfaces of the pores and wells are not blocked at their entrances.

It has been generally perceived that to obtain optimal pumping of hydrogen at the second stage, the second stage temperature must be at or below 14° K. However, it has been found that there is a specific temperature at which optimal pumping occurs under given load conditions and that below this temperature the rate of adsorption is substantially reduced. Thus, in accordance with the present invention, the temperature of the second stage is maintained at the optimal temperature for the gases and load conditions that are present.

In one embodiment, the cryopump has three different temperature stages: a first temperature stage for pumping gases which have high boiling point temperatures, such as water; a second temperature stage for pumping gases which were not pumped by the first stage; and a third temperature stage, the coldest stage, for pumping gases having a very low boiling point and were not pumped by the first two temperature stages. Located at the second and third temperature stages are adsorbents which have pores and wells for effectively adsorbing gases with different critical mobility temperatures. In this embodiment, the third temperature stage is surrounded by and separated from the second temperature stage, which is, in turn, surrounded by and separated from the first temperature stage. The spacing between the temperature stages permits unobstructed flow of low-boiling temperature gases from the first temperature stage to the third temperature stage.

A second embodiment of the invention utilizes a second stage temperature control system during pump operation to obtain optimal cryosorption of the gas being pumped at the second stage. Thus, the second stage temperature can be adjusted to maintain the second stage temperature at the optimal level. In the case of hydrogen, the temperature at which this optimum occurs is generally between 10° and 14° K. depending upon the specific $H_2$ loading of the pump. This optimal temperature of hydrogen must be maintained so that the pumped molecules can move about on the adsorbent surface without clogging the pores.

A preferred embodiment of this temperature control system incorporates a temperature sensor contacting the second stage heat sink and an electrical resistance-type heater in heat conductive contact with the second stage. The wires used to conduct power to the heating filament are hermetically sealed to avoid their exposure to volatile gases within the pumping chamber.

BRIEF DESCRIPTION OF THE DRAWINGS

The foregoing and other objects, features, and advantages of the invention will be apparent from the following more particular description of the preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

It is known that the number of molecules adsorbed per unit area equals the rate at which gas impinges on the unit area of the surface times the average time which a molecule spends on the surface. Therefore, by increasing the unit of surface area, more molecules can be adsorbed by an absorbent. Of the cryogenic adsorbents available, charcoal and zeolites are the most commonly used adsorbents because they have a large number of pores and cavities along their surfaces. The large number of pores and cavities of these adsorbents provide for a large effective surface area for adsorbing molecules relative to the size of the adsorbent. Other considerations, such as temperature and time required for activation, amount of dust produced by the adsorbent, thermal conductivity, etc., also make charcoal and zeolites the best choice.

Figure 1:
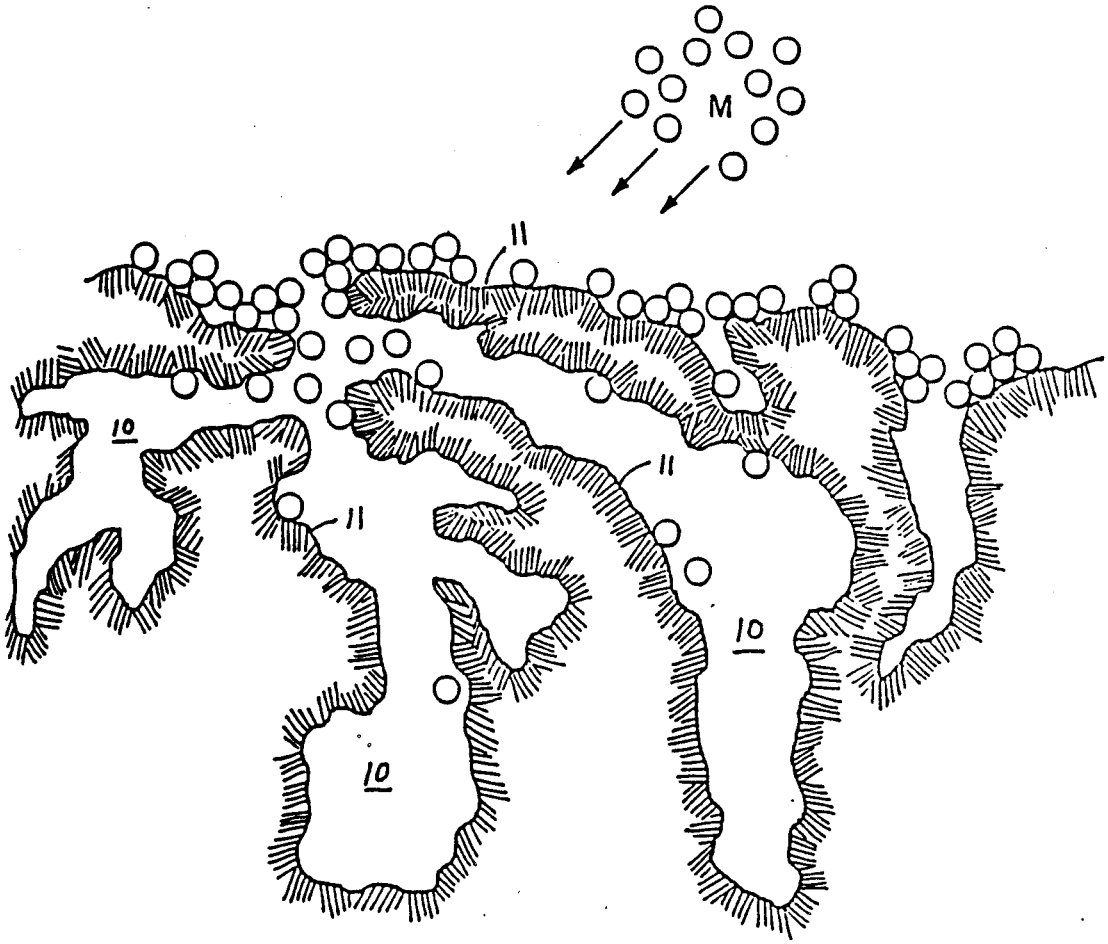
FIG. 1 is a view illustrating a magnified partial cross sectional surface of charcoal.

By way of an example, a magnified view of the surface area of charcoal is illustrated in FIG. 1. On being adsorbed, gas molecules M will migrate alonq the surface 11 of the charcoal and fall into a potential well 10 until such time as they receive enough thermal energy to desorb. The gas molecules M migrate along the surface 11 because during the time in which they remain on the surface 11 of the adsorbent, called the residence time, they are more likely to receive a small amount of energy from the adsorbent. If the temperature of the adsorbent is sufficiently low, the probability of the molecules M acquiring sufficient energy to escape or migrate along the surface 11 of the adsorbent becomes small. The molecules M thus become less mobile. Therefore, according to conventional theory, the amount of gas adsorbed must increase rapidly with decreasing temperature.

In the present invention, tests have indicated that noncodensibles such as helium, neon, and hydrogen have critical mobility temperatures when adsorbed on charcoal. Specifically, helium has been found to have a critical mobility temperature of below 5° K., neon has been found to have a critical mobility temperature of about 10° K., and hydrogen has been found to have a critical mobility temperature of about 13° K. Similarly, other noncondensibles have critical mobility temperatures. Below these critical temperatures, it is believed that the adsorbed noncondensibles can become immobile on the surface of the adsorbent. As a consequence, the entrance of the cavities and pores of the adsorbent can become blocked with immobile molecules because of its insufficient mobility to penetrate the less accessible internal areas. Such a situation is shown in FIG. 1. As a result, less effective surface area of the adsorbent is utilized to adsorb gases having a lower critical mobility temperature.

It has also been found that the rate of cryosorption of hydrogen reaches a maximum in the temperature range between 10° and 14° K. and is substantially reduced below that level. The exact temperature depends upon the level of $H_2$ loading.

Figure 4:
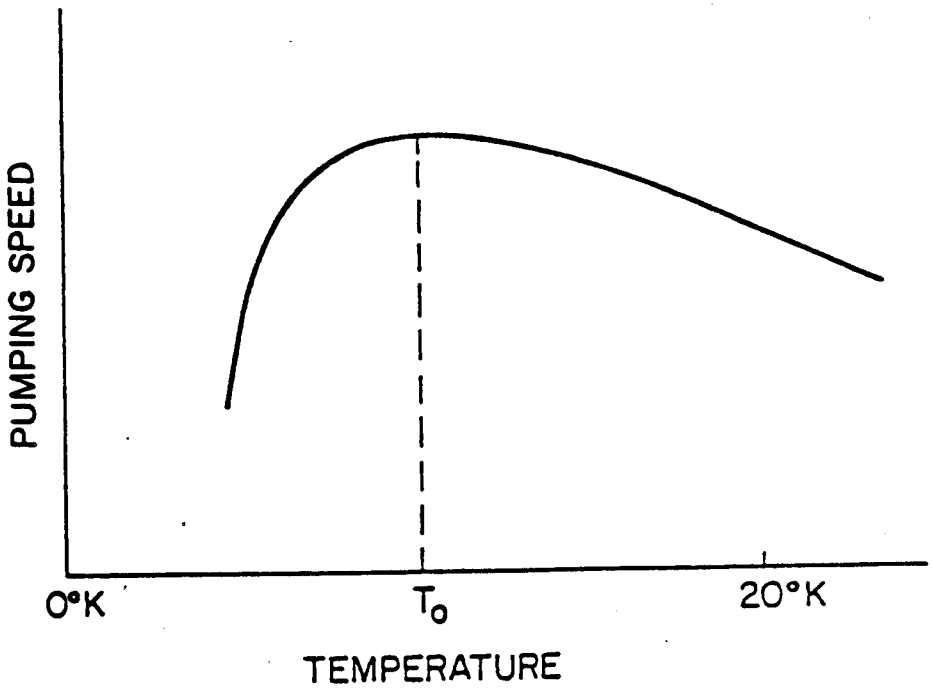
FIG. 4 is an arbitrary graphical representation of the dependence of effective pumping speed versus temperature for hydrogen under specific load conditions.

FIG. 4 is an arbitrary graphical illustration that under a given $H_2$ load condition, the rate at which hydrogen is pumping reaches an optimum value at a temperature $T_o$. As indicated above, conventional theory has taught that the amount of gas adsorbed should increase with decreasing temperature. FIG. 4 illustrates that the rate of adsorption drops rapidly at temperatures below $T_o$.

As a result, in a first embodiment, the present invention provides that an optimal cryopump can be constructed having three temperature stages: a first stage to pump gases which freeze readily at temperatures of approximately 100° K., such as water; a second stage to effectively pump gases which freeze readily at temperatures of approximately 15° K., such as nitrogen and argon, and also to provide an adsorbent to pump those noncondensibles which have a higher critical mobility temperature, such as hydrogen and neon; and a small third stage, maintained as cold as possible to effectively pump gases with very low critical mobility temperatures such as helium. Preferably, the first stage temperature is cooled to 70° to 140° K., the second stage temperature is cooled to 10° to 14° K., and the third stage temperature is cooled to approximately 5° K.

Figure 2:
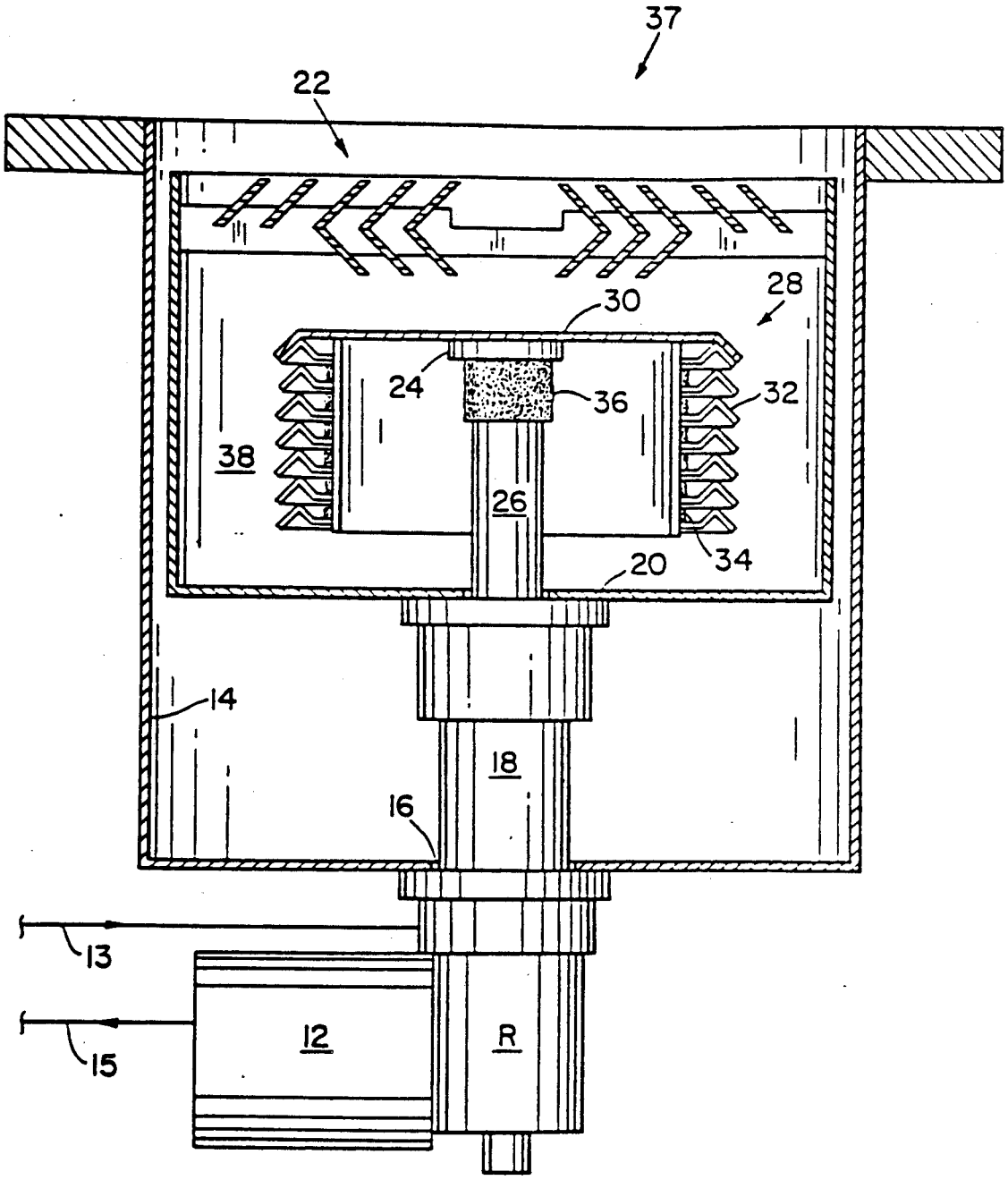
FIG. 2 is a cryopump embodying the present invention having three temperature stages.

A three temperature stage cryopump can be constructed in a variety of ways. For example, in FIG. 2, a two-staged, cold finger of a closed-cycle refrigerator R extends into a housing 14 of a conventional cryopump through an opening 16. In this case, the refrigerator is a Gifford-MacMahon refrigerator but other refrigerators may be used. In the refrigerator, a displacer in the cold finger is driven by a motor 12. With each cycle, helium gas introduced into the cold finger under pressure through a feed line 13 is expanded and thus cooled and then exhausted through a return line 15. Such a refrigerator is disclosed in U.S. Pat. No. 3,218,815 to Chellis et al.

The first stage 18 of the cold finger is mounted to a radiation shield 20 which is coupled to a frontal array 22. Typically, the temperature differential across the thermal path from the frontal array 22 to the first stage 18 of the cold finger is between 30° K. and 50° K. Thus, in order to hold the frontal array 22 at a temperature sufficiently low to condense out water vapor, the first stage of the cold finger must operate at between 90° and 110° K. The radiation shield 20 and the frontal array serve as the first temperature stage.

The cold end 24 of the second stage 26 of the cold finger is mounted to a heat sink 28. The heat sink 28 comprises a disk 30 and a set of circular chevrons 32 mounted to the the disk 30 in a vertical array. The heat sink 28 and the vertical array of chevrons 32 form the primary pumping surface of the cryopump. Along a cylindrical surface between the chevrons of the primary pumping surface is a low temperature adsorbent 34. Preferably, the primary pumping surface forms the second temperature stage and is cooled to 10° to 14° K. The temperature of the primary pumping surface can be maintained by cooling the second stage of the cold finger to approximately 5° K. and designing the heat sink 28 to use a low conductance material 30 so that the temperature differential across the heat sink 28 is approximately 9° K. The third temperature stage can be achieved by placing adsorbent 36 in thermal contact with the cold end of the second stage 26 of the cold finger. Thus, both the second and third temperature stage can be obtained from the second stage, the coldest stage, of the cold finger. Alternatively, a three-staged, closed-cycle refrigerator could be used to maintain the three temperature stages.

During operation, gases from a work chamber (not shown) enter through an opening 37 in the cryopump to the frontal array 22 where high boiling point temperature gases are condensed on the surface of the frontal array 22. Lower boiling point gases pass through that array and into a volume 38 within the radiation shield 20 where gas is condensed on the chevron surfaces 32 and adsorbed by the adsorbent 34 located on the surface between the chevrons 32. Gases having a very low boiling point, such as helium, which are not pumped by the primary pumping surface passes to the adsorbent 36 of the third temperature stage for adsorption.

In conventional cryopumps, the design of the cryopump conforms with conventional theory where it is believed that the colder the adsorbent surface the more gas that adsorbent would adsorb. In the present invention, the adsorbent along both the second and third temperature surfaces are operated at different temperatures. The adsorbent on the second temperature stage, the warmer of the two, allows gas which would otherwise be immobile on the third temperature stage to be adsorbed effectively along the entire surface area, including the wells of the adsorbent. As a result, more gas is adsorbed per surface area at the second temperature stage than conventional cryopumps because the pores and wells of the adsorbent are not blocked with immobilized gas molecules. Gases with very low critical mobility temperatures are instead pumped at the third temperature stage.

Figure 3:
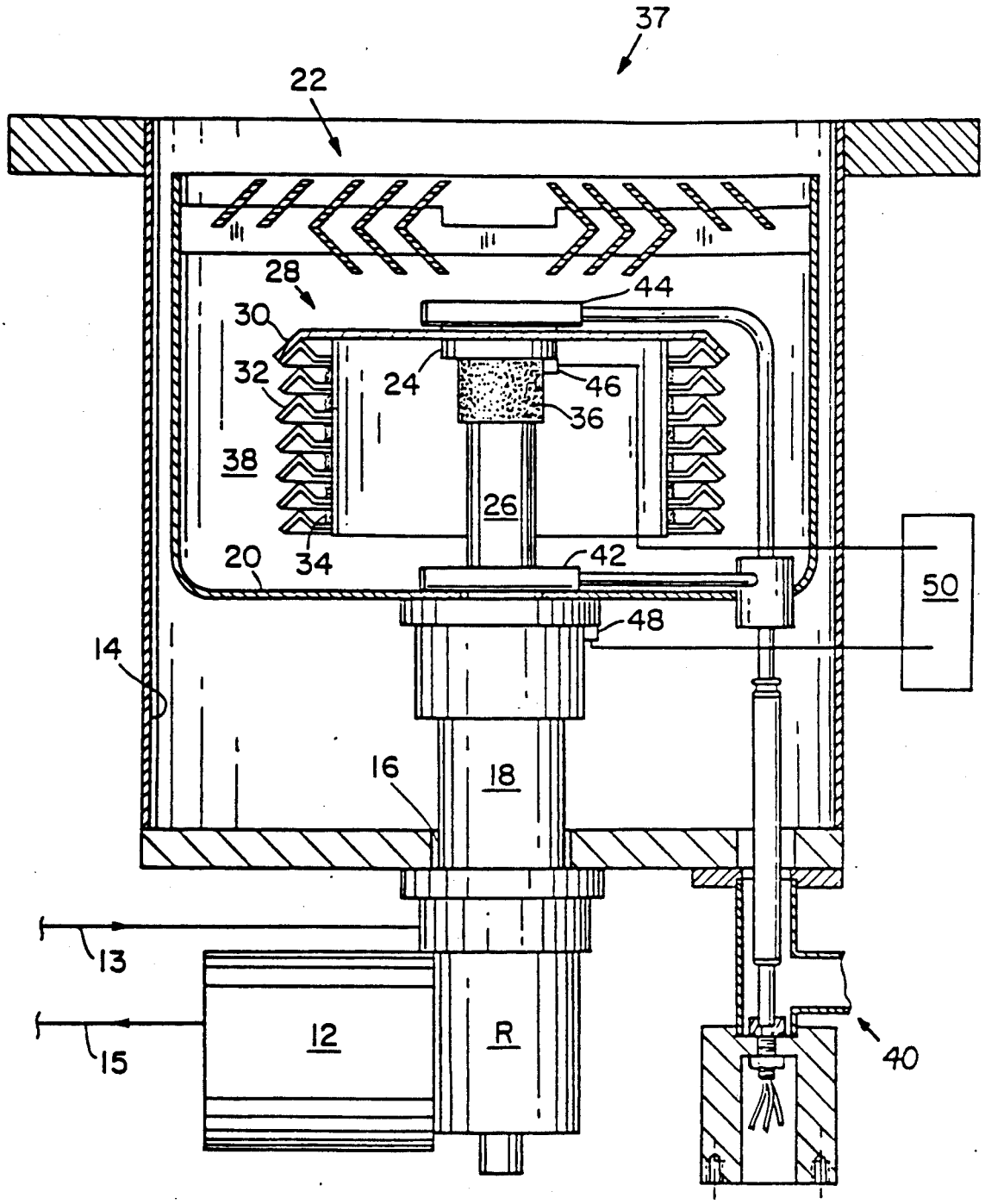
FIG. 3 is a cryopump embodying the present invention with a heater system attached to the first and second stages.

Another preferred embodiment of the invention is illustrated in FIG. 3. This embodiment utilizes a heater 40 which extends through the housing 14 and shield 20. A first heating element 42 contacts the first stage and a second heating element 44 contacts the second stage heat sink 28. The heating element 44 is used to adjust the temperature of the primary pumping surface so that there is optimal cryosorption of the gas being pumped on that surface. This embodiment uses a high conducane material such as copper for the member 30. The present embodiment uses the heating element 44 contacting the second stage heat sink to maintain the primary pumping surface at the optimal temperature $T_o$.

A temperature measuring device 46 such as a thermistor or thermocouple, is located on the cold end 24 to monitor the temperature of the primary pumping surface. The temperature measured by the monitor 46 can be used to automatically adjust the heating element 44 to maintain the predetermined temperature $T_o$. The control circuit 50 provides a signal to the heater 40 based on the sensed temperature.

The heating system 40 can also be of the type described in U.S. Pat. No. 4,679,401 wherein refrigerant gas of the refrigerator R is diverted to heat exchangers associated with the first and second stages of a cryopump. This heating system is also used to prevent crossover hangup and provide a more efficient regeneration procedure. Alternatively, a third embodiment of the invention utilizes three temperature stages with the temperature control system mounted on the second stage. This embodiment utilizes active control of the second stage temperature instead of a low conductance material for the member 30 to control the second stage temperature While the invention has been particularly shown and described with references to a preferred embodiment thereof, it will be understood by those skilled in the art that various changes in form and details may be made therein without departing from the spirit and scope of the invention as defined by the appended claims. For example, a three-staged, closed-cycle refrigerator could be used to maintain the three temperature stages. Also, as disclosed in U.S. Pat. application Ser. No. 007,019 filed on Jan. 27, 1987 by Allen J. Bartlett, separate refrigerators may be used to maintain the different temperature stages.

We claim:

1. A cryopump having a pumping operation and a regeneration cycle and comprising a first temperature stage having a first pumping surface for condensing gases, a second temperature stage having a second pumping surface with a first adsorbent thereon, the second stage being cooled to a lower temperature than the first temperature stage for pumping gases not pumped by the first pumping surface, and a third temperature stage having a second adsorbent surface and a temperature control system having a heating element in thermally conductive contact with the second temperature stage to maintain the temperature of the second stage above a minimum temperature below which the capacity of the first adsorbent, in pumping the gas to be pumped by the first adsorbent during the pumping operation, is substantially reduced.

2. A cryopump as claimed in claim 1 further comprising a second temperature control element in thermal contact with the first temperature stage.

3. A cryopump as claimed in claim 1 wherein:

the first temperature stage is cooled to approximately 90°-140° K.;

the second temperature stage is cooled to approximately 10°-14° K.; and the third temperature stage is cooled to approximately 5° K.

4. A cryopump as claimed in claim 1 wherein the second and third temperature stages are separated by a thermal insulator.

5. A cryopump a claimed in claim 1 further comprising a condensing surface on the second pumping surface for condensing lower condensation temperature gases not condensed on the first condensing surface and the first adsorbent adsorbs gases having lower condensation temperatures not condensed on the second condensing surface.

6. A cryopump as claimed in claim 1 further comprising a temperature detector for detecting the temperature of the second stage, and such that the temperature control responds to the detected temperature to maintain the temperature of the second stage at a predetermined level during pumping operation by the second stage.

7. A cryopump as claimed in claim 6 wherein the primary gas to be bumped is hydrogen, and the predetermined level at which the second stage is maintained is above 10° K.

8. A cryopump as claimed in claim 6 wherein the temperature control maintains the temperature of the second stage with an electric heater.

9. A method of adsorbing gases in a cryopump having a pumping operation and a regeneration cycle comprising the steps of:

cooling a first temperature stage of the cryopump having a first condensing surface for condensing gases; and cooling a second temperature stage of the cryopump by adsorbing gases with a second stage adsorbent; and controlling the second stage temperature during adsorption with a temperature control system such that the second stage temperature is maintained during the pumping operation above a minimum temperature below which the capacity of an adsorbent mounted on the second stage for adsorbing gases not condensed on the first stage is substantially reduced.

10. A method of effectively adsorbing gases in a cryopump as claimed in claim 9 further comprising cooling a third temperature stage of the cryopump having a second adsorbent surface for adsorbing gases not adsorbed by the second stage.

11. A method of effectively adsorbing gases in a cryopump as claimed in claim 9 wherein:

the first temperature stage is cooled to approximately 90°-140° K.;

the second temperature stage is cooled to approximately 10°-14° K.; and the third temperature stage is cooled to approximately 5° K.

12. A method of adsorbing gases in a cryopump as claimed in claim 9 wherein the second temperature stage of the cryopump has a second condensing surface and the adsorbent for condensing and adsorbing lower condensation temperature gases than condensed on the first stage; and further comprising;

cooling a third temperature stage of the cryopump having a second adsorbent surface for adsorbing gases not adsorbed by the second stage.

13. A method of adsorbing gases in a cryopump as claimed in claim 9 wherein:

the first temperature stage is cooled in approximately 90°-140° K.;

the second temperature stage is cooled to approximately 10°-14° K.; and the third temperature stage is cooled to approximately 5° K.

14. A method of adsorbing gas in a cryopump as claimed in claim 9 further comprising detecting the temperature of the second stage and responding to the detected temperature to maintain the temperature of the second stage at a predetermined level during pumping operation by the first and second stages.

15. A method as claimed in claim 14 wherein the predetermined temperature is a critical temperature below which the capacity of the adsorbent, in pumping the principal gas to be pumped by the second stage adsorbent, is substantially reduced.

16. A method as claimed in claim 15 wherein the primary gas to be pumped is hydrogen, and the predetermined level at which the second stage is maintained above about 10 K.

* * * * *

UNITED STATES PATENT AND TRADEMARK OFFICE

CERTIFICATE OF CORRECTION

PATENT NO. : 5,001,903

DATED : March 26, 1991

INVENTOR(S) : Philip A. Lessard and Thomas Dunn

It is certified that error appears in the above-identified patent and that said Letters Patent is hereby corrected as shown below:

Col. 6 :

In Claim 7, line 2, change "bumped" to --pumped--.

Col. 7:

In Claim 9, line 8, change "by" to --for--.

Signed and Sealed this

Twenty-first Day of September, 1993

Bruce Lehman

*Attest:*

BRUCE LEHMAN

*Attesting Officer*

*Commissioner of Patents and Trademarks*